US010531784B2

(12) United States Patent
Sweigart

(10) Patent No.: US 10,531,784 B2
(45) **Date of Patent: *Jan. 14, 2020**

(54) DEVICE AND METHOD FOR REMOVING FUR AND HAIR FROM FABRICS

(71) Applicant: Michael Sweigart, Waretown, NJ (US)

(72) Inventor: Michael Sweigart, Waretown, NJ (US)

( * ) Notice: Subject to any disclaimer, the term of this patent is extended or adjusted under 35 U.S.C. 154(b) by 72 days.

This patent is subject to a terminal disclaimer.

(21) Appl. No.: 16/004,948

(22) Filed: Jun. 11, 2018

(65) Prior Publication Data

US 2018/0289239 A1 Oct. 11, 2018

Related U.S. Application Data

(63) Continuation-in-part of application No. 15/356,780, filed on Nov. 21, 2016, now Pat. No. 10,280,551.

(51) Int. Cl.

| | |
|---|---|
| ***A47L 25/00*** | (2006.01) |
| ***D06F 58/22*** | (2006.01) |
| ***D06F 37/06*** | (2006.01) |
| ***D06F 58/04*** | (2006.01) |
| ***D06F 39/02*** | (2006.01) |

(52) U.S. Cl.

CPC ..... *A47L 25/005* (2013.01); *D06F 37/06* (2013.01); *D06F 58/22* (2013.01); *D06F 39/024* (2013.01); *D06F 58/04* (2013.01)

(58) Field of Classification Search

CPC ..... D06F 58/22; D06F 58/203; A47L 25/005; B08B 7/0028

See application file for complete search history.

(56) References Cited

U.S. PATENT DOCUMENTS

| | | | | |
|---|---|---|---|---|
| 3,878,818 A | | 4/1975 | Thettu et al. | |
| 4,004,685 A | * | 1/1977 | Mizuno | D06F 58/203 206/0.5 |
| 4,014,105 A | * | 3/1977 | Furgal | C11D 3/0015 34/389 |
| 4,014,432 A | * | 3/1977 | Clothier | D06F 58/203 206/0.5 |
| 4,490,870 A | | 1/1985 | Taub | |
| 4,532,722 A | * | 8/1985 | Sax | D06F 58/203 206/0.5 |
| 4,872,416 A | | 10/1989 | Daniel et al. | |
| 4,920,662 A | | 5/1990 | Seeburger | |
| 5,423,411 A | | 6/1995 | Kennett | |
| 5,502,873 A | | 4/1996 | Hogan | |
| D396,904 S | * | 8/1998 | Leu | D21/713 |

(Continued)

*Primary Examiner* — David J Laux

(74) *Attorney, Agent, or Firm* — Thomas J. Germinario

(57) ABSTRACT

A disk, ball or sheet/strip shaped device is made of a silicone or thermoplastic elastomer substance having a tacky surface and a Shore Durometer hardness preferably in the range of 10 to 40. The device is adapted to be placed into a laundry washer or dryer, such that the tumbling motion causes the tacky surfaces of the device to rub against the clothing, thereby removing pet fur. Further tumbling causes the fur collected on the device to eventually disengage and be caught in the lint filter, vent or drain of the washer/dryer. In an alternate embodiment, the tacky silicone or thermoplastic elastomer can form a liner on agitators, fins or paddles within the washer/dryer so as to collect animal fur from fabrics.

7 Claims, 2 Drawing Sheets

(56) References Cited

U.S. PATENT DOCUMENTS

| | | | | |
|---|---|---|---|---|
| 6,174,577 | B1 * | 1/2001 | Vitorino | D06F 58/203 428/36.5 |
| D516,261 | S * | 2/2006 | Roberts | D32/25 |
| 7,441,345 | B2 * | 10/2008 | Taylor | D06F 58/203 34/406 |
| 10,280,551 | B2 * | 5/2019 | Sweigart | D06F 39/00 |
| 2007/0084003 | A1 | 4/2007 | Straub et al. | |
| 2017/0055807 | A1 * | 3/2017 | Rucki | A47L 25/005 |

* cited by examiner

DEVICE AND METHOD FOR REMOVING FUR AND HAIR FROM FABRICS

REFERENCE TO RELATED APPLICATION

This application is a continuation-in-part of U.S. patent application Ser. No. 15/356,780, filed Nov. 21, 2016.

FIELD OF INVENTION

The present invention relates to the field of devices and methods for cleaning fabrics, and more particularly to devices and methods for removing pet fur from clothing and other fabrics.

BACKGROUND OF THE INVENTION

One of the most difficult cleaning tasks is the removal of pet fur from clothing and other fabrics. (As used herein, the term "fabric" applies to any type of cloth or textile comprising natural and/or synthetic materials.) Hair and fur tend to cling to fabrics by entanglement and static attraction. Current cleaning methods involve the use of adhesives, such as tape rollers, which can damage delicate fabrics and/or leave a residue on them. Such methods typically involve pain-staking manual cleaning, which is often hit-or-miss. Since fur and hair cannot readily be extracted from adhesive surfaces, such cleaning devices are usually limited to a single use, after which they must be disposed of and replaced.

The present invention addresses these deficiencies by providing a non-adhesive fur-removing device adapted for use in standard clothes washers and dryers.

SUMMARY OF THE INVENTION

In one embodiment, the present invention comprises a disk or ball shaped device or a strip/sheet made of a silicone elastomer or a thermoplastic elastomer (TPE) substance, which has a tacky surface and a Shore Durometer hardness preferably in the range of 10 to 40. The device is adapted to be placed into a laundry washer or dryer, such that the tumbling motion causes the tacky surfaces of the device to rub against the clothing, thereby removing pet fur. Further tumbling causes the fur collected on the device to eventually fall off and be caught in the lint filter, vent or drain of the washer/dryer. In an alternate embodiment, the tacky silicone or thermoplastic elastomer can form a liner on tubs, drums, agitators, fins or paddles within the washer/dryer so as to collect animal fur and hair from laundered fabrics.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENTS

Figure 1:
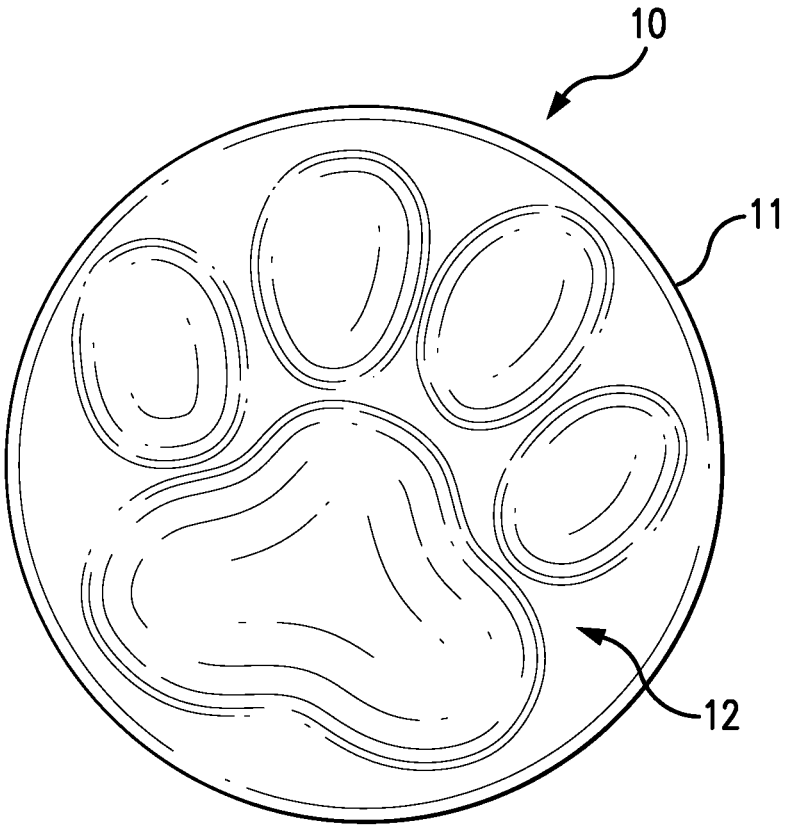
FIG. 1 is a plan view of a first embodiment of the present invention.
Figure 2:
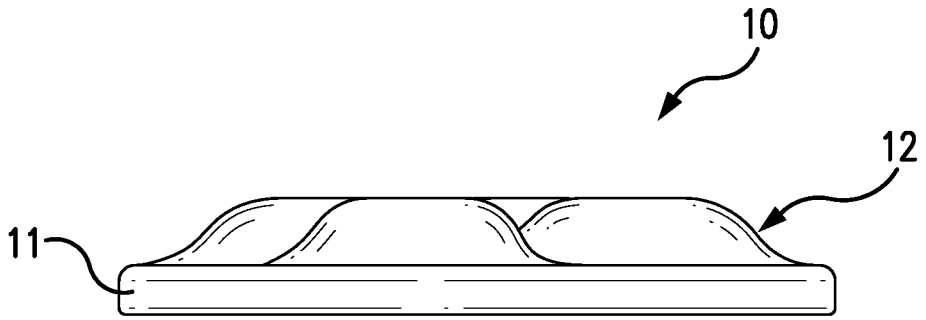
FIG. 2 is a profile view of the first embodiment of the present invention.

FIGS. 1 and 2 illustrate the first embodiment of the present invention 10, which has the form of a disk 11. A textured pattern 12 is contoured on one side of the disk 11, in order to increase its surface area for optimal contact with the clothing, as well as to add weight to the device, so as to stabilize its spinning/tumbling motion inside the washer/dryer and prevent its adherence to the interior surfaces of the washer/dryer.

Figure 3:
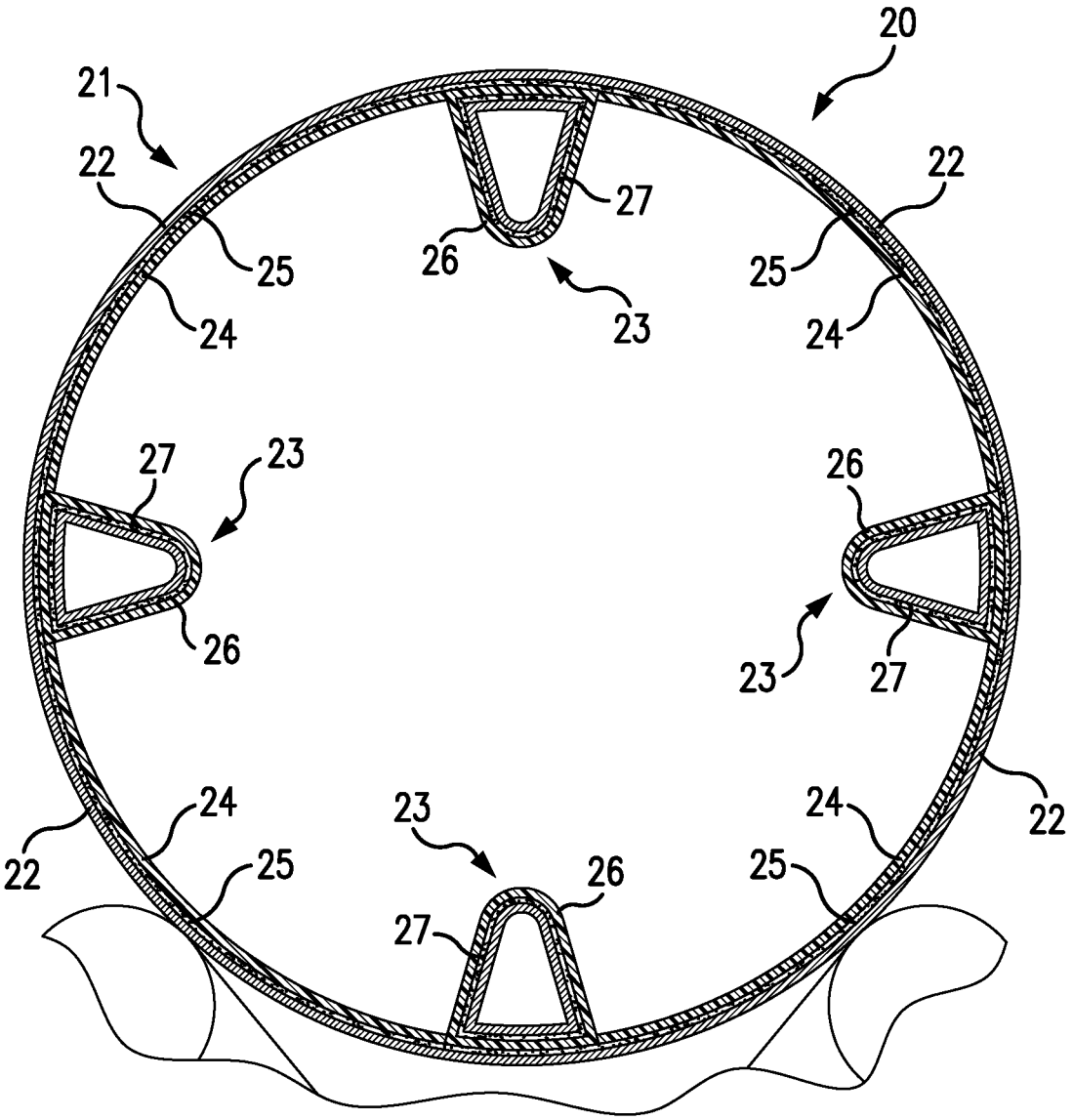
FIG. 3 is a cross-sectional view of a second embodiment of the present invention.

FIG. 3 illustrates the second embodiment of the present invention 20, in which a silicone or thermoplastic elastomer layer 24 26 is adhered or bonded to interior drum walls 22 and/or dryer paddles 23 within a dryer drum 21. The silicone or TPE layer 24 lining the drum walls 22 has beneath it a bonding layer 25, which can comprise adhesive, magnetic, mechanical and/or hook-and-loop fasteners, and which secures the silicone or TPE layer 24 to the drum wall 22. Similarly, the silicone or TPE layers 26 over the dryer paddles 23 are secured to the paddles 23 by a bonding layer 27, which can comprise an adhesive, which secures the silicone or TPE layers 26 to the paddles 23. Although the exemplary embodiment of FIG. 3 is depicted with reference to a dryer, it should be understood that equivalent silicone or thermoplastic elastomer layers can be advantageously applied to corresponding structures within a washer, such as drums, tubs, agitators, and paddles.

Although the preferred embodiment of the present invention has been disclosed for illustrative purposes, those skilled in the art will appreciate that many additions, modifications and substitutions are possible, without departing from the scope and spirit of the present invention as defined by the accompanying claims.

What is claimed is:

1. A method for removing fur and hair from a fabric while the fabric is being washed in a washer and/or dried or tumbled in a dryer, the method comprising the steps of:

(a) providing an object comprising an object surface and a solid object interior, wherein the object surface consists of a heat-resistant, tacky surface material consisting of an elastomeric substance which is either a silicone elastomer substance or a thermoplastic elastomer substance, and wherein the object has an object shape which is configured to facilitate multiple contacts between the object surface and the fabric while the fabric is being washed in the washer and/or dried or tumbled in the dryer, and wherein the elastomeric substance has an elastomer hardness such that the surface material has a tackiness, in an operating temperature range of the washer and the dryer, which attracts and retains the fur and the hair from the fabric, but which allows the fur and the hair to become dislodged from the surface material during the movements of the object in the washer and/or the dryer, so that dislodged fur and hair is collected in the washer and/or the dryer;

(b) inserting or installing the object into the washer and/or into the dryer;

(c) inserting the fabric into the washer and/or into the dryer along with the object;

(d) washing and/or drying or tumbling the fabric;

(e) attracting the fur and hair from the fabric onto the tacky surface material of the object;

(f) dislodging the fur and hair from the object as the object moves within the washer and/or within the dryer; and (g) collecting dislodged fur and hair in the washer and/or in the dryer.

2. The method according to claim 1, wherein the object interior comprises the elastomeric substance.

3. The method according to claim 1, wherein the object shape is a disk or a ball.

4. The method according to claim 1, wherein the object shape is a sheet.

5. The method according to claim 4, wherein the object interior comprises a bonding layer by which the object surface is secured to one or more attachment surfaces within the washer or the dryer.

6. The method according to claim 1, wherein a hardness of the elastomeric substance, as measured by a Shore Durometer, is less than 60.

7. The method according to claim 6, wherein the hardness of the elastomeric substance, as measured by a Shore Durometer, is in the range of 10 to 40.

* * * * *